United States Patent [19]

Focke et al.

[11] Patent Number: 5,052,995

[45] Date of Patent: Oct. 1, 1991

[54] PROCESS AND APPARATUS FOR THE STOCKING (STORAGE) OF (PACK) BLANKS AND FOR FEEDING THESE TO A FOLDING UNIT OF PACKAGING MACHINE

[75] Inventors: Heinz Focke; Kurt Liedtke, both of Verden, Fed. Rep. of Germany

[73] Assignee: Focke & Co., (GmbH & Co.,), Verden, Fed. Rep. of Germany

[21] Appl. No.: 501,827

[22] Filed: Mar. 28, 1990

[30] Foreign Application Priority Data

Apr. 5, 1989 [DE] Fed. Rep. of Germany ..... 3910987

[51] Int. Cl.[5] ..... B65H 45/00

[52] U.S. Cl. ..... 493/410; 493/416; 414/795.8

[58] Field of Search ..... 493/410; 414/795.8, 414/392; 271/9

[56] References Cited

U.S. PATENT DOCUMENTS

| | | | |
|---|---|---|---|
| 3,907,273 | 9/1975 | Runyan et al. | 414/795.8 |
| 3,914,154 | 10/1975 | Pfeiffer | 271/9 |
| 4,260,310 | 4/1981 | Blake et al. | 414/795.8 |

FOREIGN PATENT DOCUMENTS

| | | | |
|---|---|---|---|
| 258597 | 8/1986 | European Pat. Off. . | |
| 0095784 | 2/1973 | Fed. Rep. of Germany . | |
| 2534917 | 2/1977 | Fed. Rep. of Germany . | |
| 3627868 | 2/1988 | Fed. Rep. of Germany . | |
| 3716897 | 12/1988 | Fed. Rep. of Germany . | |
| 2072216 | 9/1971 | France . | |
| 0023168 | 3/1981 | Japan | 493/410 |

*Primary Examiner*—Frederick R. Schmidt
*Assistant Examiner*—John A. Marlott
*Attorney, Agent, or Firm*—Sughrue, Mion, Zinn, Macpeak & Seas

[57] ABSTRACT

Process and apparatus for the stocking (storage) of (pack) blanks and for feeding these to a folding unit of a packaging machine. The supply of packaging material to a packaging machine is especially difficult in the processing of blanks made of cardboard. Supply becomes easier if blanks joined together via residual connections are conveyed as a web of material in the packaging machine. Especially favorable storage of blanks (11) connected to one another is possible if the web of material (19) so formed is arranged in a zigzag-shaped manner as a result of oppositely directed folding and the blanks are stacked in this way. The stacks (15) formed can be kept in stock in a space-saving way and fed to an extraction station, in which the web of material (19) is drawn off from the stacks (15) and restored to the extended state. Appropriately, a plurality of stacks (15) is connected to one another, specifically via vertical web portions (23) from one stack to another, to form a continuous web of material (19).

5 Claims, 8 Drawing Sheets

38
39
41
40
19
42
42
43
23
23
20
15
20
15
20
20
16
30/31

PROCESS AND APPARATUS FOR THE STOCKING (STORAGE) OF (PACK) BLANKS AND FOR FEEDING THESE TO A FOLDING UNIT OF PACKAGING MACHINE

BACKGROUND OF THE INVENTION

The invention relates to a process for the stocking (storage) of (pack) blanks and for feeding these to a folding unit of a packaging machine, especially blanks for the production of hinge-lid packs for cigarettes, the blanks being connected to one another to form a continuous web of material and being severed from this for processing. The invention relates, furthermore, to an apparatus for carrying out the process.

Supplying high-performance packaging machines with the necessary packaging material presents a special problem. Packs made of thin cardboard, for example for the production of hinge-lid packs for cigarettes, have hitherto mainly been produced from factory-prefabricated pack blanks which are delivered in stacks and which are introduced into a magazine of the packaging machine. The feeding of the blank magazine involves a high outlay in terms of labour because of the rapid consumption of the blanks.

Alternatively to this, blanks consisting of (thin) cardboard can also be supplied to the packaging machine in the form of a continuous web of material. In this case, the blanks are preformed within the web of material by stamping and embossing, but are connected to one another, to form the web of material, via residual connections or thin webs. In this known proposal, the residual connections are arranged in the region of those parts of the blanks which remain concealed in the finished pack (DE-A-3,716,897).

SUMMARY OF THE INVENTION

The invention is concerned with the expedient storage or stocking of (pack) blanks which, in accordance with the foregoing state of the art, are connected to one another to form a continuous web of material. The object on which the invention is based is to stock or store the web of material in such a way that it can be supplied to the packaging machine or to the packaging members of this in an especially efficient way.

To achieve this object, the process according to the invention is characterized in that the web of material is arranged in stacks, at the same time being folded in a zigzag-shaped manner, oppositely directly folds being formed respectively in the region of connections between adjacent blanks, and in that the zigzag-shaped web of material is drawn off from the stack and into an extended form for the production of the individual blanks.

The arrangement of the web of material in the stack in a concertina-like disposition affords an especially high storage capacity, since the cuboid stacks can be arranged in a space-saving way. Also, the processing of the web of material within the packaging machine can be carried out easily by drawing the web of material off from the stacks and by shaping it back into the extended state.

According to a further important proposal of the invention, an on-running continuous web of material is arranged in a plurality of connected stacks, the stacks being joined to one another by means of extended web portions of the web of material A stock of blanks consisting of a plurality of stacks can be processed as a continuous unit and without interruption. The lower or last blank of a particular stack is connected to the first or upper blank of a following stack via a vertical extended web portion The vertical web portion extends as a separating member between two directly and closely adjacent stacks.

According to the invention the stacks formed from the web of material are provided severally in groups and are fed in succession to a locally fixed extraction station in or on the packaging machine. In the region of the extraction station, the stacks are in succession reduced, thereby forming the continuous web of material. The extraction station can be made stationary, the stacks being fed to the extraction station in succession. Alternatively, a draw-off member for the web of material can travel by degrees from one stack to the next in the extraction station.

According to a further proposal of the invention, a plurality of groups of stacks arranged respectively in a row is stored on a base (pallet) and transferred in succession from this base on to a conveyor assigned to the packaging machine.

Further features of the invention relate to the design of the web of material and to the apparatuses and units for the automatic feeding of the stacks of blanks to the extraction station and to the design of the extraction station.

The process according to the invention and an exemplary embodiment of the apparatus are explained in detail below by means of the drawings. In these:

DETAILED DESCRIPTION OF PREFERRED EMBODIMENT

Figure 1:
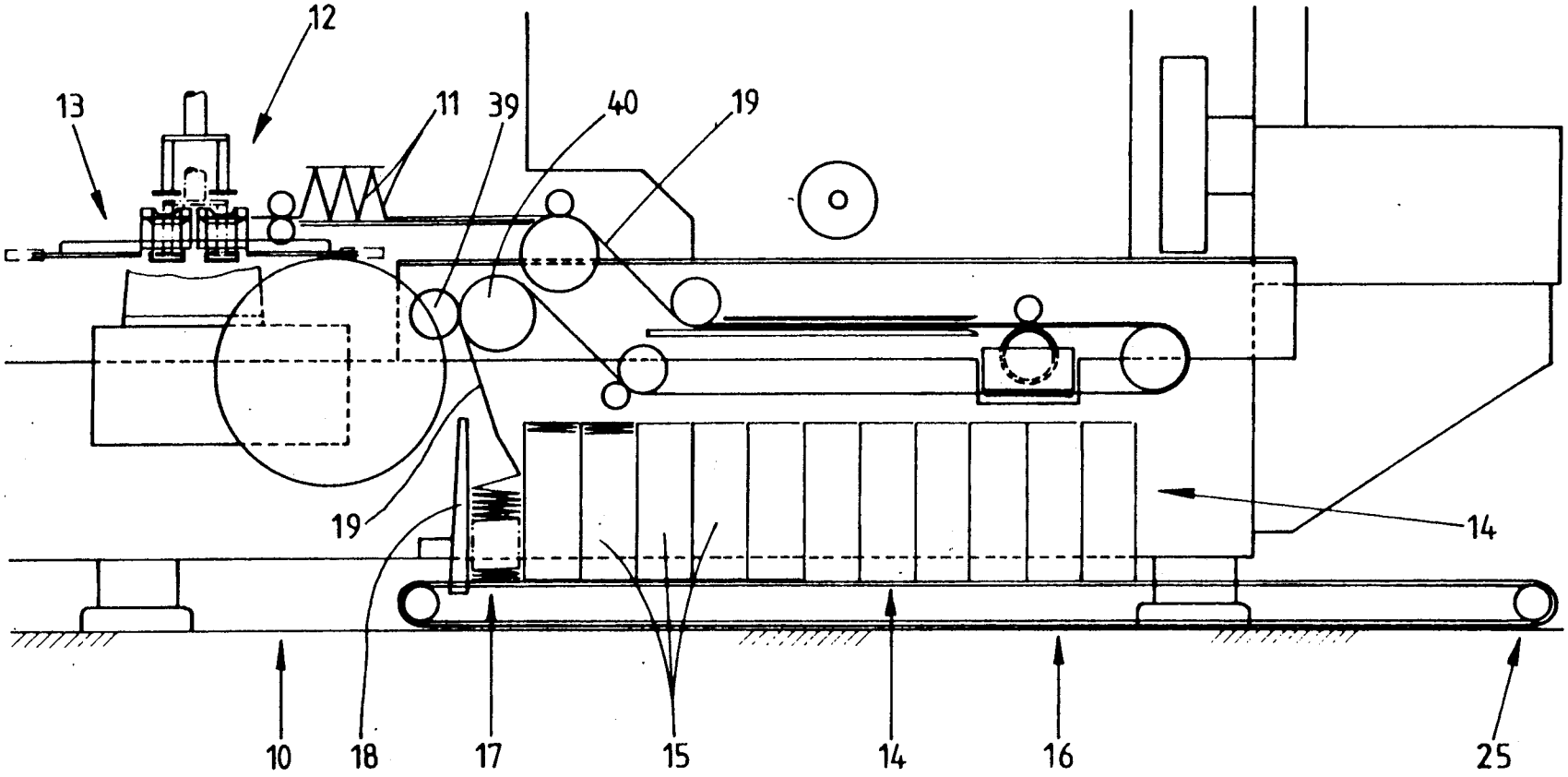
FIG. 1 shows a dragrammatic side view of a packaging machine or of part of this.

The details illustrated in the drawings relate to the supply of a packaging machine 10 with blanks 11 made of (thin) cardboard for the production of (cigarette) packs of the hinge-lid type. The blanks 11 pass into a blank station 12 of the packaging machine 10 and here, as a result of a downward movement, into pockets of a folding turret 13 arranged in a disc-like manner and rotatable about a vertical axis.

The packaging machine 10 has available to it a relatively large blank stock 14, specifically a plurality of stacks 15 arranged closely next to one another and consisting of blanks 11 arranged above one another. In the present exemplary embodiment, the stacks 15 are provided on a stack conveyor 16, specifically a band conveyor, which feeds the stacks 15 in succession to a locally fixed extraction station 17. The particular stack 15 located at the front in the conveying direction is reduced continuously The position of the stack 15 in the extraction station 17 is determined by a stationary stop, particularly by a vertical stop wall 18.

The stacks 15 are formed from continuous webs of material 19 which themselves consist of a plurality of blanks 11 connected to one another at the longitudinal edges. In the region of the blank station 12, the blanks 11 are severed from the web of material 19 and further processed individually.

The web of material 19 is folded in a zigzag-shaped manner to form the stacks 15. Oppositely directed folding edges 20 are formed at the respective edges of the blanks 11.

The web of material 19 is essentially designed here as illustrated and described in DE-A-3,716,897. Blanks 11 for the production of hinge-lid packs are connected to one another at the longitudinal edges by means of tear-off or sheer-off residual connections 21. In comparison with the exemplary embodiment of DE-A-3,716,897, according to FIG. 7 blanks 11 are equipped with an integrally connected collar. To that extent, the blanks correspond to the embodiment in EP-B-6,872.

The stacks 15 formed from the folded web of material 19 are opened up in the extraction station 17 by restoring to the extended state the web of material 19 drawn off on the top side of a stack.

Figure 3:
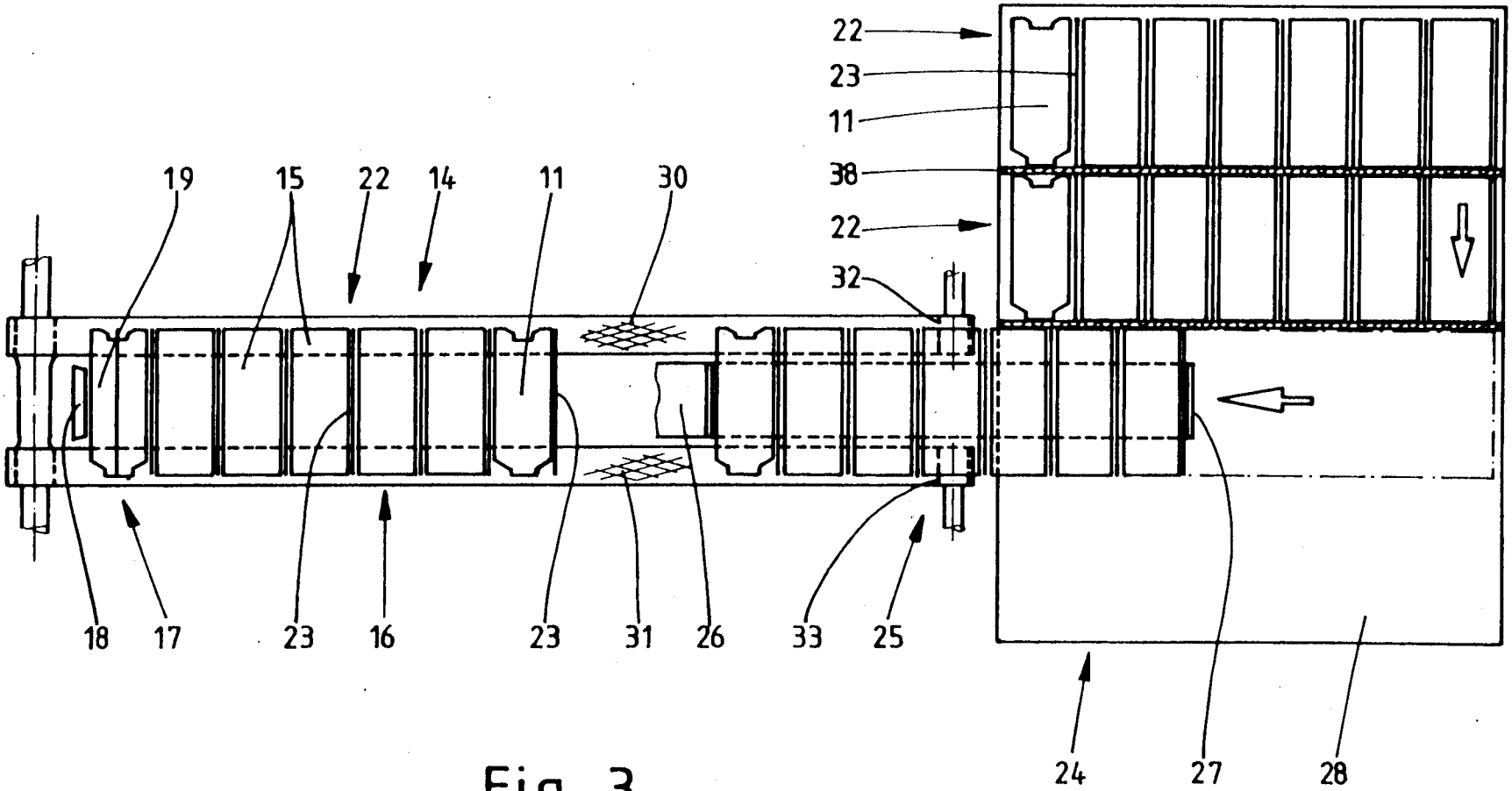
FIG. 3 shows a plan view of FIG. 2.
Figure 6:
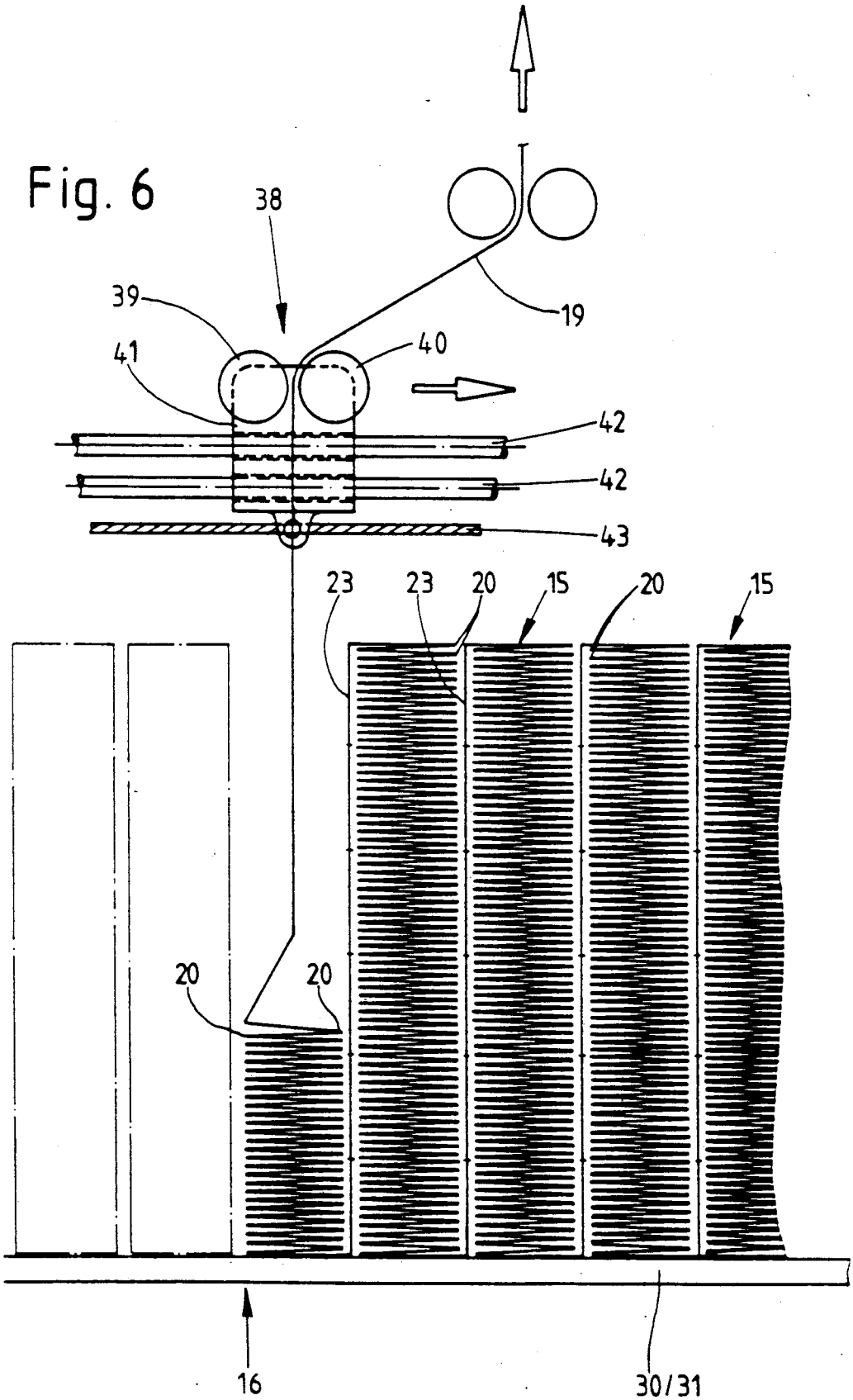
FIG. 6 shows a side view of details of an extraction station for the reduction of the stacks.

For the mechanization of the reduction of a plurality of stacks 15 of the blank stock 14, a plurality of stacks 15 arranged next to one another, namely a group 22, are formed from a continuous uninterrupted web of material 19. This means that the stacks 15 belonging to a group 22 of this kind are connected to one another, specifically by an extended, that is to say non-folded web portion 23. In the present exemplary embodiment, this runs from the lower end of one stack 15 or from the lower blank 11 of the latter to the upper end or upper blank 11 of the next following stack 15. The web portion 23 is at the same time arranged in a vertical plane, specifically as a separating member between the closely adjacent stacks 15 (FIG. 6). The entire group 22 consisting, for example, of seven stacks 15 (FIG. 3) can accordingly be reduced in succession as a continuous web of material without any manual involvement.

Figure 4:
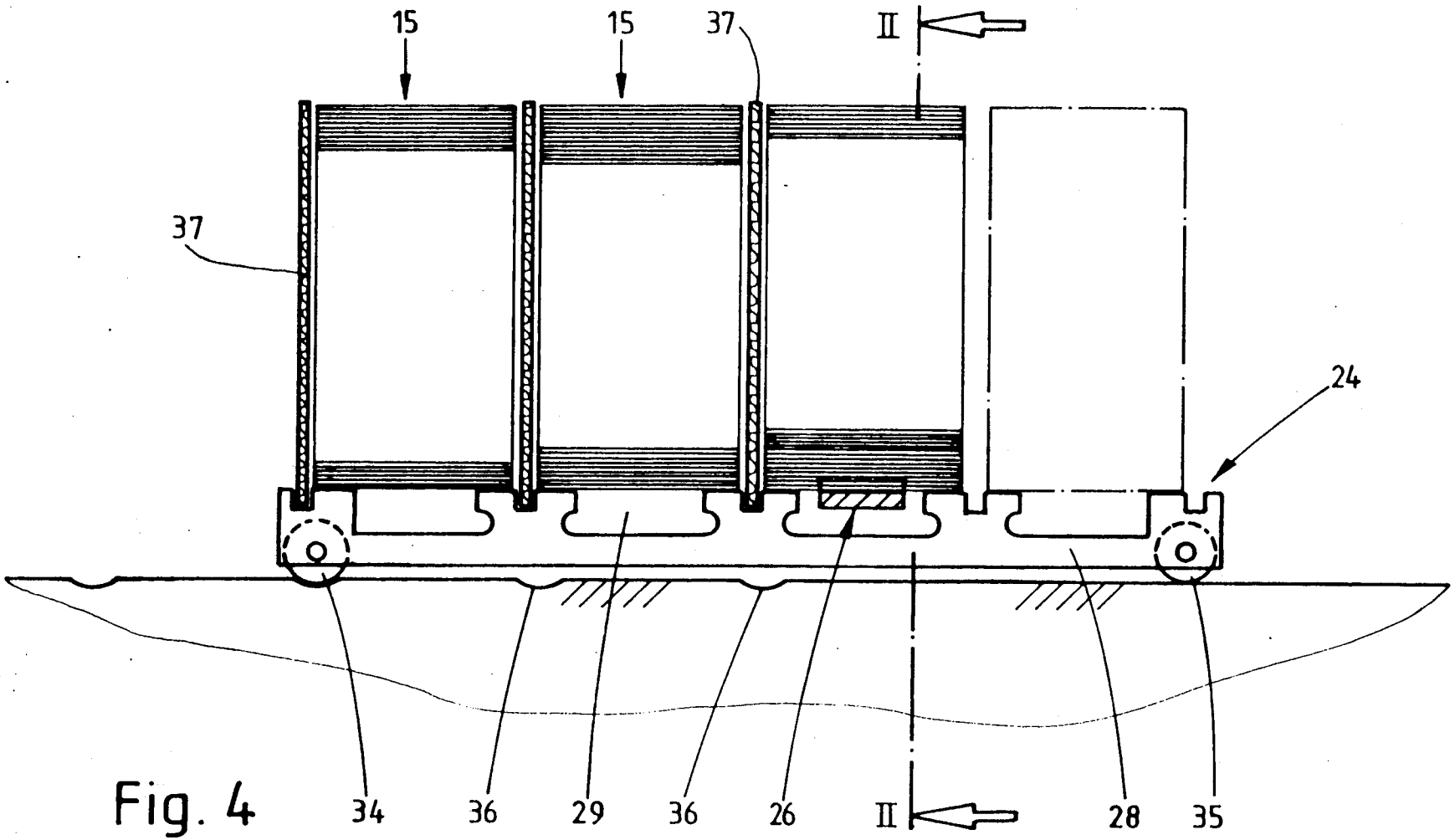
FIG. 4 shows an end view of a pallet for the stocking of stacks.
Figure 5:
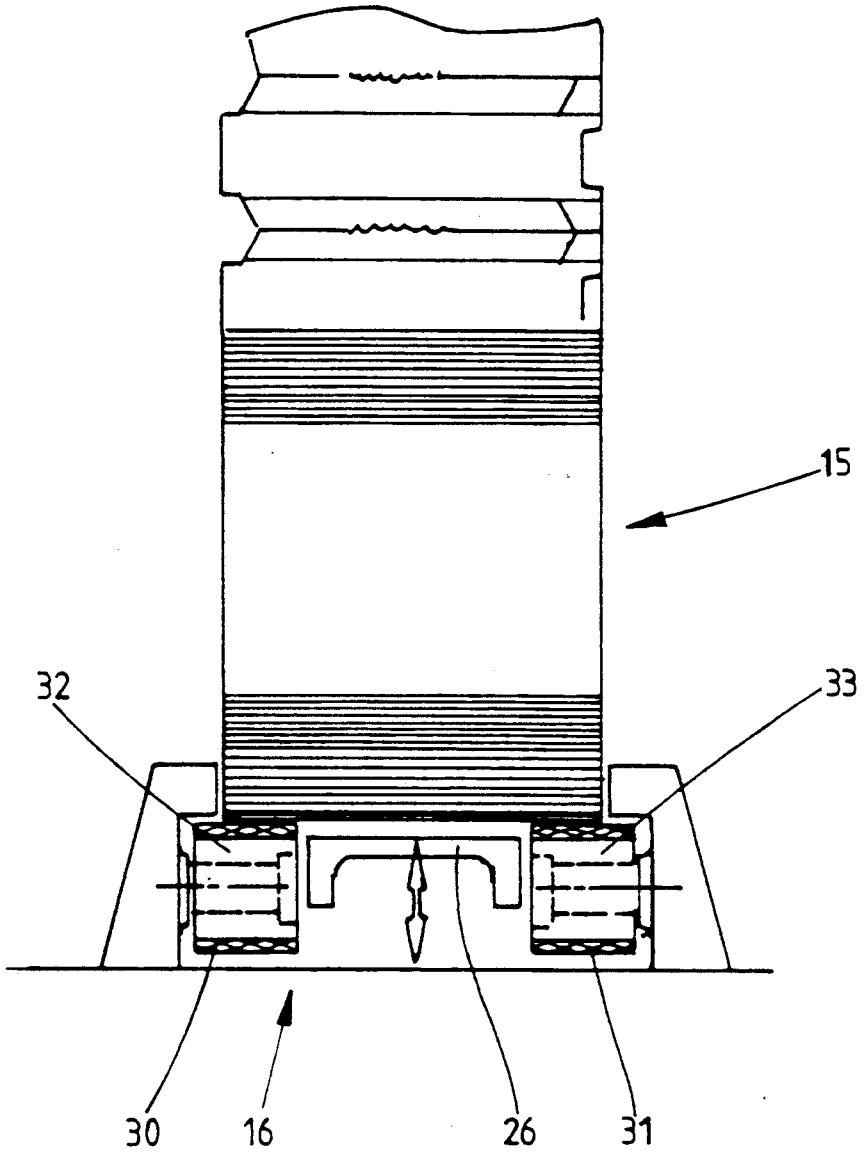
FIG. 5 shows a transverse view or section of a stack conveyor as part of the packaging machine.

In order to increase the storage capacity in the region of the packaging machine, a plurality of groups 22 of stacks 15 are kept ready and placed on the stack conveyor 16 in succession. The groups 22 are received on a movable carrier structure, particularly a pallet 24 designed in a special way. In the present exemplary embodiment (FIGS. 3 and 4), this is suitable for receiving four groups 22 of connected stacks 15. The pallet 24 is movable in front of a feed end 25 of the stack conveyor 16 transversely relative to this, in such a way that a group 22 of stacks 15 arranged next to one another is always aligned with the stack conveyor 16.

When the blank stock 14, namely a group 22 of stacks 15, formed on the stack conveyor 16 is almost empty, after a preceding transverse displacement of the pallet 24 a further group 22 is received onto the stack conveyor 16. The transfer of a group 22 from the pallet 24 to the stack conveyor 16 takes place automatically.

For this purpose, a particular group 22 of stacks 15 on the pallet 24 is grasped on the underside by a lifting conveyor 26, lifted off from the pallet 24, moved in the longitudinal direction and deposited on the stack conveyor 16. The lifting conveyor 26 is designed as an elongate carrier arm with a stop elevation 27 at the free end. The lifting conveyor 26 is movable to and fro in the longitudinal direction of the stack conveyor 16 to a point underneath a group 22, the stop elevation 27 laterally grasping a stack 15 located at the edge.

For the above-mentioned conveying movement of the lifting conveyor 26, the pallet 24 is designed in a special way. A bottom plate 28 of the pallet 24 is equipped with recesses 29 on the top side. These channel-like recesses 29 extend in the longitudinal direction of a particular group 22 and underneath this, the width of the recess 29 being clearly less than the length of a stack 15 and therefore than the length of a blank 11. A stack 15 can rest with edge or end regions on the bottom plate 28. In the middle region the stack 15 is exposed, so that the lifting conveyor 26 can be moved underneath the stacks 15 here in order to grasp a group 22.

The stack conveyor 16 too is matched to the mode of operation of the lifting conveyor 26, particularly consisting of two lateral belt conveyors 30, 31 arranged at a distance from one another. The stacks 15 rest on these with lateral or end regions. At the feed end 25, the two belt conveyors 30, 31 run over deflecting rollers 32, 33 which are not connected to one another and between which a clearance for the conveying movement of the lifting conveyor 26 remains.

The pallet 24 is equipped on the underside with running rollers 34, 35. By means of these, the exact relative position of the pallet 24 in relation to the stack conveyor 16 can also be fixed because at least one pair of the running rollers 34, 35 penetrates into depressions 36 of a running surface for the pallet 24.

On the pallet 24, the individual groups 22 are divided off from one another by means of partition walls 37. These are arranged removably on the pallets 24 for the return transport of these to the production location of the blanks 11 or of the web of material 19. The partition walls 37 consist, here, of corrugated cardboard.

FIG. 6 illustrates an alternative as regards the design of the extraction station 17. The draw-off of the web of material 19 and consequently the reduction of the stacks 15 do not take place in a stationary manner here. On the contrary, a draw-off member 38 for the web of material 19 is arranged displaceably above the stacks 15. The draw-off member 38 is moved (intermittently) from stack to stack in accordance with the reduction of the stacks 15. While the web of material 19 is being drawn off, the draw-off member 38 is located centrally above the stack 15 to be reduced.

In the present exemplary embodiment, the draw-off member 38 consists of a pair of draw rollers 39, 40. The web of material 19 is drawn off from the stack 15 by these, being extended at the same time. The (driven) draw rollers 39, 40 are arranged on a slide 41 which is displaceable above the row or group 22 of stacks 15. In the present exemplary embodiment, two guide rods 42 are moved. For executing the adjusting movement, a pull member, namely a pull cord 43, is arranged on the slide 41. The pull cord 43 is actuated intermittently by a suitable drive member.

Figure 7:
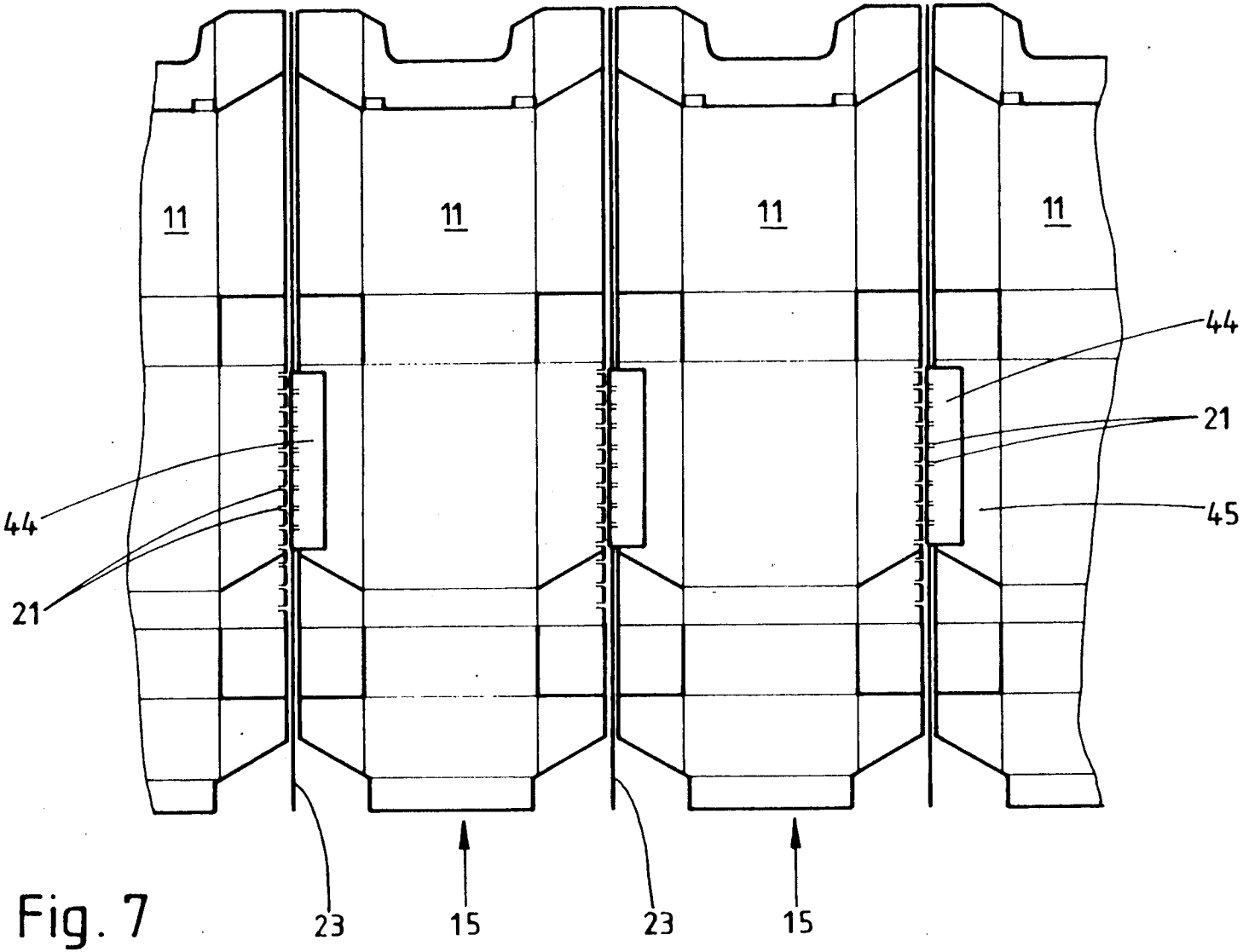
FIG. 7 shows a portion of a web of material on an enlarged scale.
Figure 8:
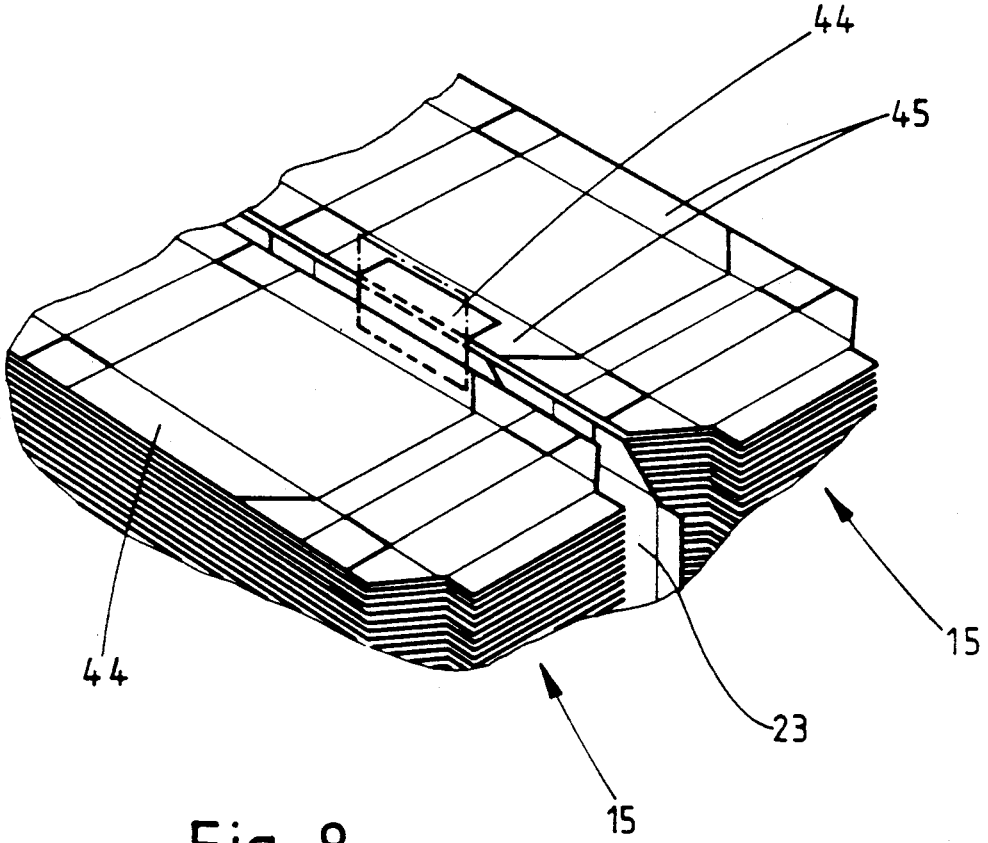
FIG. 8 shows a perspective representation of the upper region of two stacks of blanks.

A further special feature is shown in detail in FIGS. 7 and 8. This relates primarily to the joining to one another, that is to say the connection of successive groups 22 of stacks 15. For this purpose, an adhesive element, namely an adhesive strip 44, is arranged on the outer free edge of the last blank 11 of the web of material 19 or of the vertical web portion 23. This adhesive strip 44 provided with an adhesive layer on one side is affixed in a middle region of the (last) blank 11, namely on an inner side tab 45. The adhesive strip 44 is arranged, so as to form a free projection, on the edge of the side tab 45, specifically on the side remote from the following stack 15. The part of the adhesive strip 44 projecting upwards beyond the blank 11 is folded round for connection to the upper horizontal blank 11 of a following stack 15 and thus adhesively bonded to the top side of the blank, likewise in the region of the side tab 45. The connection between the webs of material is thereby made and a continuous reduction of an uninterrupted web of material guaranteed.

Figure 2:
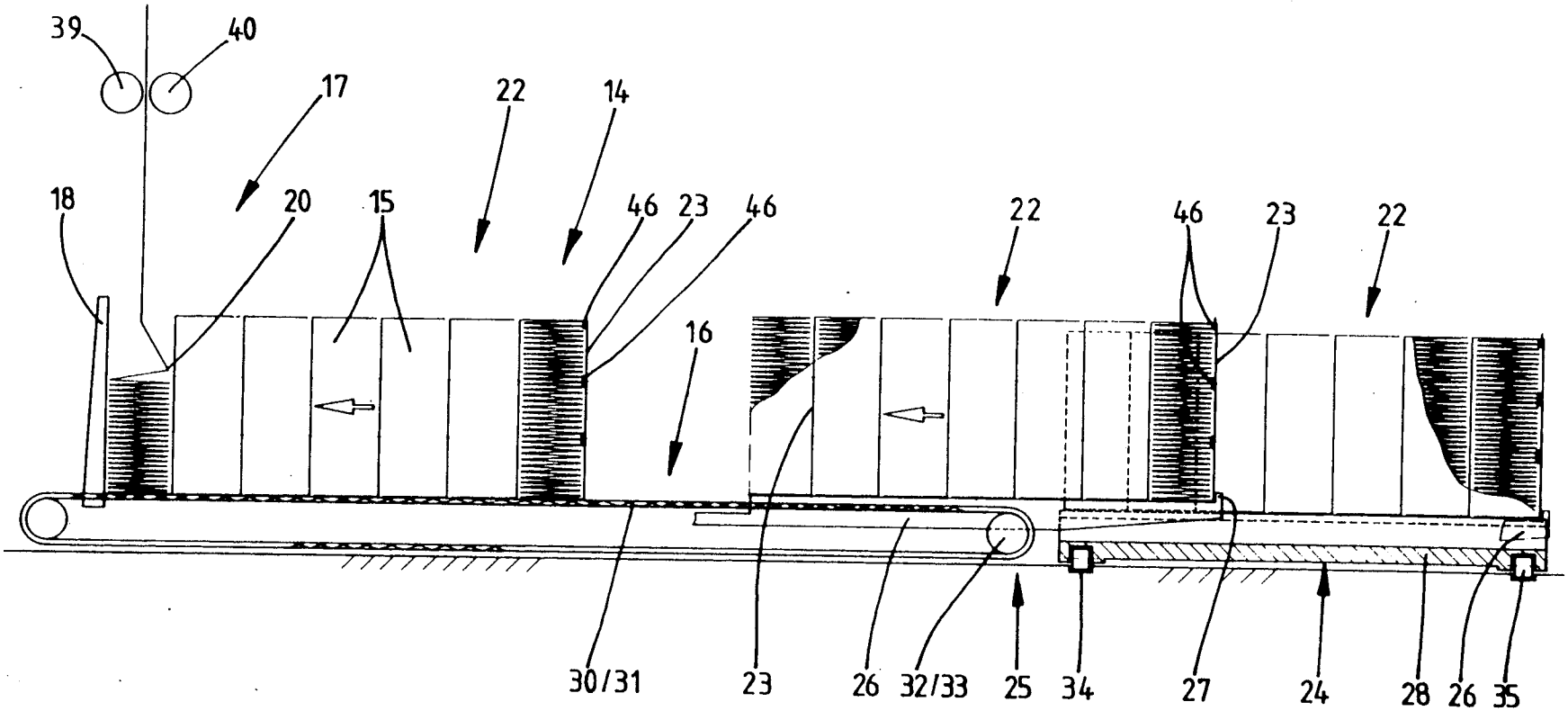
FIG. 2 shows a side view, on an enlarged scale, of details of the supply of stacks of blanks to the packaging machine.

To secure the web portions 23 in the vertical extended position, especially on a last stack 15 located at the edge, it is expedient to have holding means which secure the respective exposed web portion 23 on the side face of the associated stack 15. In the present exemplary embodiment (FIG. 2), connecting strips 46 adhesive on both sides are arranged in the region of the connection point between adjacent blanks 11 on the web portion 23, on the side facing the stack 15. These connecting strips 46 are connected on the one hand adhesively to the web portion 23 and on the other hand likewise adhesively to the folding edges of the stack 15. The vertical web portion 23 is thereby secured releaseably in position.

What is claimed is:

1. (Twice Amended) Process for stocking of blanks and for feeding the blanks to a folding unit of a packaging machine, individual blanks being connected to one another to form a continuous web of material and being subsequently severed from the web for processing, said process comprising the steps of:

arranging the web (19) in a plurality of adjacent connected vertical stacks (15) in which the web (19) is folded in a zigzag-shaped manner with oppositely directed folds formed respectively along connections between adjacent blanks (11) in the web; and drawing off the zigzag-shaped web (19) from a first stack (15) and into an extended form for the production of the individual blanks (11);

wherein a last blank (11) of each stack (15) is connected to a first blank (11) of a following adjacent stack (15) via a vertical extended web portion (23) of the web (19), the vertical extended web portion (23) serving at the same time as a separating member between the adjacent stacks (15);

wherein the uppermost blank (11) of the vertical extended web portion (23) of a last stack (15) in a first group of stacks is equipped with a connection means (44) which projects beyond the uppermost blank (11) and which, by being folded round, is connected to the uppermost blank (11) of a first stack (15) of a second group (22) of stacks (15); and wherein the vertical web portion (23) of a last stack (15) of each group (22) of stacks is connected by connection means (46) to a side face of the last stack (15) and is thus kept in a vertical position.

2. Process according to claim 1, wherein an on-running continuous web of material (19) is arranged in the plurality of connected stacks (15), and wherein said drawing off set comprises reducing the stacks in succession.

3. Process for storing of thin cardboard packaging blanks and for feeding the blanks to a folding unit of a packaging machine, individual blanks being connected to one another to form a continuous web of material and being subsequently severed from the web for processing, said process comprising the steps of:

storing a single continuous web (19) in a first group of a plurality of closely adjacent connected vertical stacks (15) in which the single continuous web (19) is folded in a zigzag-shaped manner with oppositely directed zigzag folds formed respectively along residual connections between adjacent blanks (11) in the single continuous web;

connecting a lowermost blank (11) of the first stack (15) to an uppermost blank (11) of the next following adjacent stack (15) via an upright vertical extended web portion (23) of the single continuous web (19), the upright extended vertical web portion (23) serving at the same time as a separating member between the closely adjacent stacks (15) to prevent said zigzag folds of said closely adjacent stacks from entering each other;

selecting said vertical extended web portion (23) to contain a plurality of said blanks; and drawing off the zigzag-shaped single continuous web (19) from the first stack (15) and into an extended form for the production of the thin cardboard individual blanks (11), and reducing the slacks in succession.

4. Process according to claim 3, wherein said upright vertical extended web portion (23) is an upwardly directed extension of the zigzag-folded single continuous web (19) in said first stack, and wherein said connecting step further comprises the step of connecting the uppermost blank of said upright extended vertical web portion to the uppermost blank in said following adjacent stack so that the extended web portion (23) is parallel to said stacks and forms an angle of substantially 90° with said lowermost blank in said first stack and with said uppermost blank in said following adjacent stack.

5. Process according to claim 4 further comprising the step of adhesively connecting the uppermost blank in the vertical extended web portion (23) of the last following adjacent stack in said first group to the uppermost blank in the first stack of a second group of a plurality of closely adjacent connected vertical stacks (15).

* * * * *